United States Patent [19]

Dowd

[11] 4,138,073

[45] Feb. 6, 1979

[54] REELED WEB UNWIND STAND

[75] Inventor: Daniel J. Dowd, Williamsport, Pa.

[73] Assignee: Westvaco Corporation, New York, N.Y.

[21] Appl. No.: 899,177

[22] Filed: Apr. 24, 1978

[51] Int. Cl.[2] ..... B65H 19/18

[52] U.S. Cl. ..... 242/58.2; 83/171

[58] Field of Search ..... 242/58.2, 58.3, 58.4, 242/58.1, 58, 58.5, 55, 56 R, 56 A; 83/171, 177, 431

[56] References Cited

U.S. PATENT DOCUMENTS

| | | | |
|---|---|---|---|
| 1,878,184 | 9/1932 | Roesen | 242/58.3 |
| 2,320,658 | 6/1943 | Roesen | 242/58 |
| 2,783,000 | 2/1957 | Huecking et al. | 242/56.6 |
| 3,091,411 | 5/1963 | Hearns | 242/56 A |
| 3,131,278 | 4/1964 | Rosenthal | 83/171 X |
| 3,134,005 | 5/1964 | Mayhew | 83/171 |
| 3,299,756 | 1/1967 | Rosenthal | 83/171 X |
| 3,876,324 | 4/1975 | Ballard | 83/431 X |

*Primary Examiner*—George F. Mautz

*Attorney, Agent, or Firm*—W. Allen Marcontell; Ernest B. Lipscomb, III

[57] ABSTRACT

A continuous web converting machine is supplied with web material from a spider wheel unwind stand having a shiftable wheel axis. Movement of the spider wheel axis is regulated by a double acting fluid cylinder for controlled force application of the working web supply reel against a closed circuit pulling belt. Depletion of the working reel is detected by a limit switch actuated by contact with the shift carriage. upon working reel depletion, the pressure bias on the fluid cylinder is reversed and the shift carriage retracted to free the working reel from contact with the pulling belt. Thereafter, the spider wheel is rotatively indexed 120° to align a full reel in the working position. Said full reel is prepared with a strip of double faced adhesive tape secured across the full reel web leading edge to facilitate web continuity and splice from a depleted reel to a full one. Return of the shift carrier presses the taped leading edge of the full reel into the remaining tail of the depleted reel against the pulling belt with a controlled pressure. A directed air stream into the remaining tail web between the pulling belt nip and the depleted reel core billows the web against an electric resistance heated ni-chrome wire to sever such remaining tail.

3 Claims, 7 Drawing Figures

REELED WEB UNWIND STAND

BACKGROUND OF THE INVENTION

1. Field of the Invention

The present invention relates to methods and apparatus for the continuous supply of reeled web material such as paper into a continuous converting machine.

2. Description of the Prior Art

Continuous web converting machines such as printing presses and cutter/slitters are generally constructed to draw material from a supply reel.

So as to expedite the transition from a depleted reel to a full reel, spider wheel turret mechanisms are used such as that disclosed by O. C. Roesen in his U.S. Pat. No. 2,320,658.

To level the inertial forces as a web is unreeled, it is known to use a closed circuit pulling belt bearing against a small arcuate portion of the active reel. The belt is independently driven thereby driving the active reel at a substantially constant surface velocity.

Due to the fact that the reel diameter diminishes as it is depleted of web, it is necessary to accommodate such dimension changes in a manner consistent with the constant surface velocity. Furthermore, in the case of extremely soft web reels such as creped paper and the like, it is necessary to provide a carefully controlled bearing force against the reel.

Normally, these opertional constraints are accommodated by the use of weighted or spring loaded dancer rolls in the pulling belt circuit. These devices maintain a constant belt tension notwithstanding geometric changes in the circuit.

When the dancer roll pulling belt system is used in combination with a spider wheel unwind stand, an unusually large change in circuit geometry must be accommodated due to the arcuate sweep of the spider wheel about a fixed spider wheel axis.

Consequently, the magnitude of machine length and volume to accommodate the increased dancer roll stroke is proportionately increased. In some instances, as in the case of Roesen patent disclosure, supra, the pulling belt unit of the machine is so large as to be positioned beyond the reel unwind stand from the converting machine, per se. This arrangement severely restricts operator accessibility of the unwind stand for loading and unloading.

Another limiting facet of the spider wheel unwind stand arrangement is that of web severance from the depleted reel after a splice from a full reel has been completed. It is difficult to adapt conventional web cutters due to the necessity for cutter structure to be positioned within the swept volume of the reel magazine.

It is an object of the present invention therefore, to provide a web tail severance method and apparatus suitable for use with unwind stands of the rotating turret or spider wheel type.

SUMMARY OF THE INVENTION

The spider wheel unwind stand of the present invention includes a longitudinally shiftable carriage for the spider wheel rotational axle. Movement of such carriage and hence, the spider wheel axle, is controlled by a linear motor such as a double acting piston and cylinder. Fluid control over the linear motor includes close order pressure regulation of the in-feed stroke of the piston to maintain a substantially constant bearing pressure of an active web feed reel against the pulling belt. In the opposite direction, the fluid motor strokes to shift the spider wheel carriage out of bearing contact between the pulling belt and the depleted reel.

A different drive is used to power rotation of the spider wheel and limit switches set to the physical position of the shift carriage and the spider arms control the functional sequence of the two motors.

The pulling belt unit used in cooperation with the present unwind stand is a basic closed course belt drive without dancer rolls or other course geometry change accommodations. Belt material is selected by the degree reel wrap desired and the tensile yield characteristics of the material.

To transfer the web supply continuity from a depleted reel to a full one, a strip of double faced adhesive tape is applied to the leading edge of the full reel web. This full reel is then oriented relative to the spider wheel so that the tape strip will press a portion of the depleted reel web against the pulling belt when the spider wheel is rotated and advanced against the belt. Simultaneous with the pressured contact of the adhesive against the depleted web, an air stream directed between the spider wheel mounted web reels billows the remaining depleted web tail against an electric resistance heated ni-chrome wire to sever the tail by burning thereby completing the web transfer splice.

BRIEF DESCRIPTION OF THE DRAWING

Relative to the drawing wherein like reference characters are used throughout the several figures to designate like or similar elements.

DESCRIPTION OF THE PREFERRED EMBODIMENT

Figure 1:
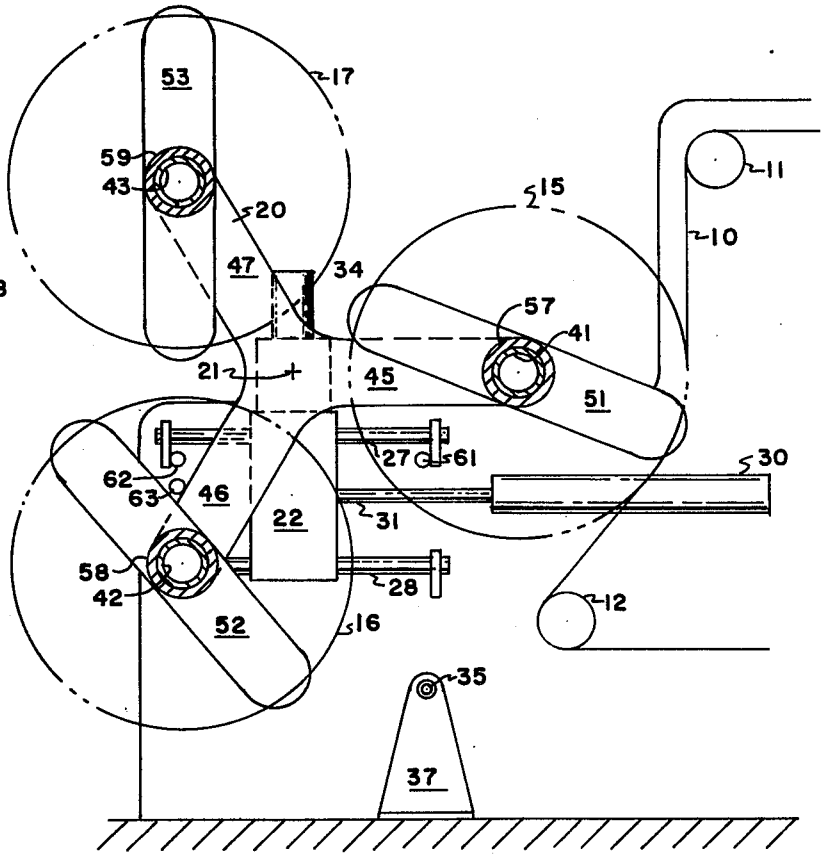
FIG. 1 is an elevational profile of the invention as sectioned along cut line I—I of FIG. 2.
Figure 2:
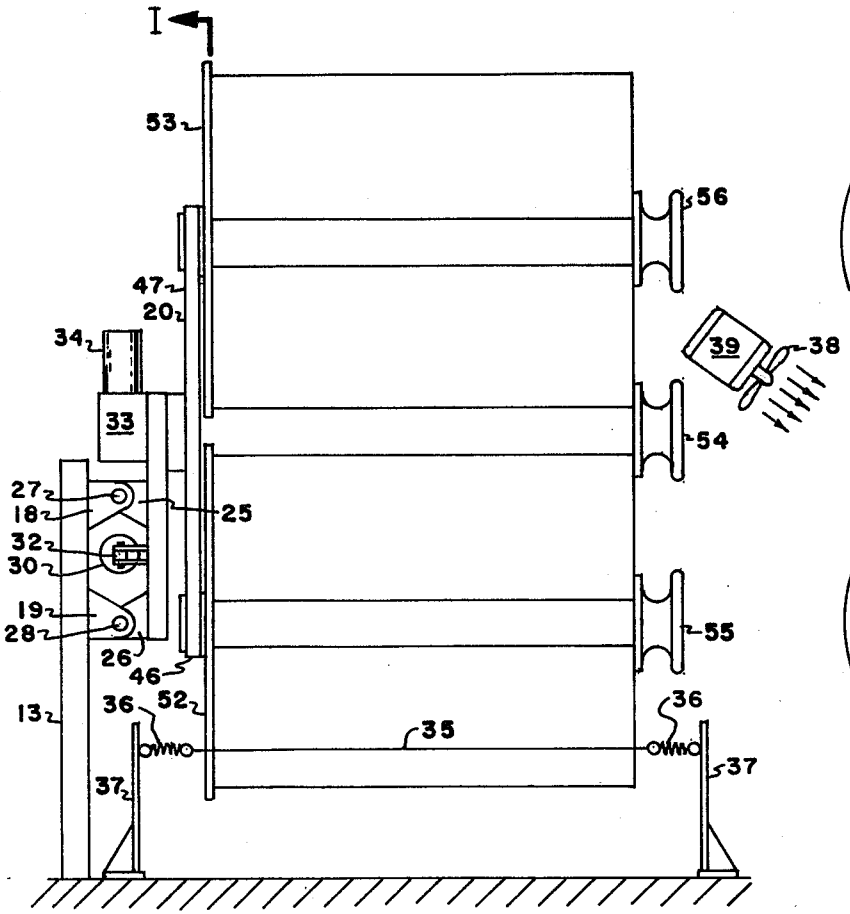
FIG. 2 is an elevational end view of the present invention.

Giving initial reference to FIGS. 1 and 2 of the drawing, the present unwind station is disposed at the web supply end of a suitable converting machine such as a slitter/-rewinder or printing press not shown. An endless pulling belt 10 coursed around turning rolls 11 and 12 is drawn over an arcuate surface portion of an active web supply reel 15 thereby rotating the reel and carrying unwinding web into the first operating station of the converting machine. Since the pulling belt 10 tension is controlled by a reel in-feed mechanism, no dancer rolls, tension weights or other such means are required for the pulling belt 10. Accordingly, very little machine space is required for the pulling belt unit.

The unwind turret of the present invention basically comprises a spider wheel 20 mounted for selectively driven rotation about a spider axis 21. Supporting the spider axis 21 is a shift carrier 22 having linear bearing mounts 25 and 26 for each of two guide bars 27 and 28. The guide bars 27 and 28 are rigidly secured to a frame side panel 13 by means of brackets 18 and 19.

Also secured to the shift carrier 22 by means of a clevis joint 32 is the rod end 31 of a reversible fluid motor such as a double acting air cylinder 30. The base of this shift cylinder is secured to the frame panel 13. A pressure controlled air supply, not shown, powers the cylinder 30. Appropriate fluid controls are provided to rapidly expand the rod 31 from the cylinder 30 for retraction of the spider unit 20 away from the pulling belt 10. Close order pressure control over the piston/-cylinder contraction regulates the magnitude of tension within the pulling belt 10 as the working web supply reel 15 diminishes in circumference.

Rotation of the spider wheel 20 is controlled by means of a worm drive reduction gear unit 33 driven by motor 34.

At the distal end of each spider arm 45, 46 and 47 is provided a rotatable reel mandrel 41, 42 and 43. Secured to the reel mandrels at the hub end next to the respective spider arm for rotation with the mandrel are flange plates 51, 52 and 53. Manually detachable end plates 54, 55 and 56 are provided on the free end of the cantilevered mandrels 41, 42 and 43 to secure the lateral positionment of a web reel along the mandrels between the flange plates and end plates.

Figure 3:
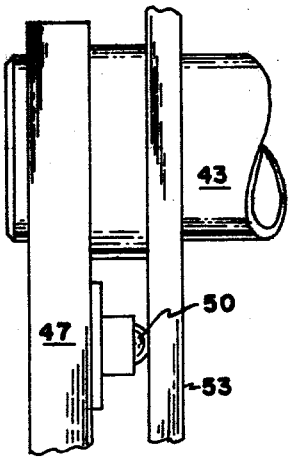
FIG. 3 is a detail of a suitable detent mechanism used with the invention.

A rotational inhibiting device such as detent mechanism 50 shown in FIG. 3 is disposed between each spider arm 47 and the respective flange plate 57. The mechanism illustrated comprises a caged, spring biased ball member secured to the spider arm and a socket in the flange plate. Alternatively, a spring blade secured to the spider arm having sufficient length for light flexure against the flange plate may be sufficient.

Web winding cores 57, 58 and 59 are shown by FIG. 1 in operative position about respective mandrels for descriptive clarity. Normal industry practice is to wind a continuous length of web about such cores 57, 58 and 59 for handling and shipment.

In the lower quadrant of the unwind stand is provided a web sear cutting unit comprising an electric resistance heating element such as a ni-chrome wire 35 suspended between two pedestals 37 by springs 36. Heating control over the cutting unit, not shown, should provide a wire surface temperature sufficient to sever the web by searing upon momentary contact. Conversely, the wire should not be so hot as to initiate combustion of the web material due to such contact. Such temperature quantities, of course, vary between diverse materials but determination of thermal magnitude is unnecessary due to the fact that a proper wire heat setting may be found quickly by simple experimentation with the apparatus as constructed.

As a further safety consideration, it should be noted that many web materials to which the invention is adapted, such as creped paper, are treated with one or more flame inhibiting compounds. Consequently, such materials will not support combustion in a normal atmosphere.

Cooperative with the sear cutting unit is an air stream source such as a fan 38 driven by a motor 39. The fan structure is positioned outside of the swept volume of reels 15, 16 and 17 when mounted on the spider wheel 20 but so aligned as to direct the air stream driven thereby through the space between the depleted reel mandrel 45 and the spider wheel axle 21.

Figure 4A:
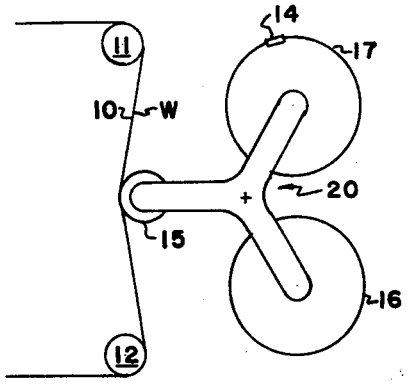
FIGS. 4A-4D are sequential operation schematics representative of the invention operating cycle.

Operational and positional sequence over the present invention is controlled by three limit switches 61, 62 and 63 which initiate respective fluid and electrical power responses. Limit switch 61 is positioned stationarily relative to the frame 13 for closure by physical contact with a portion of the shift carrier 22. Exact positionment of the switch 61 is determined by the location of shift carrier 22 when a working web reel 15 is substantially depleted. This condition is represented by FIG. 4A at which time the dependent converting machine is stopped and the fluid controls over cylinder 30 are switched to the retraction mode. Additionally, the fan 38 is started and heating of the sear cutting wire 35 begun.

Figure 4B:
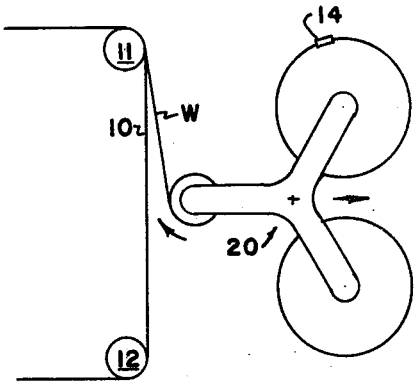

FIG. 4B illustrates the spider wheel 20 in the full retracted position whereat the limit switch 62 is closed to start drive motor 34 thereby causing rotation of the spider wheel 20 as illustrated by FIG. 4B.

Element 14 throughout FIGS. 4A–4D represents a strip of double faced adhesive tape applied to the leading edge of the web W wound as reel 17. When the full reel 17 is placed on the mandrel 43, the reel is rotated relative to the mandrel and backing flange 53 so that the web leading edge may be retained in the approximate position indicated. The detent element 50 bearing on the flange plate 53 prevents the assembly from rotating away from the set position due to imbalance. A spot of viscous grease or similar tacky substance between the web leading edge and the previous wrap will prevent the leading edge from sliding off the index position as the spider rotates the full reel into the pulling belt 10.

Figure 4C:
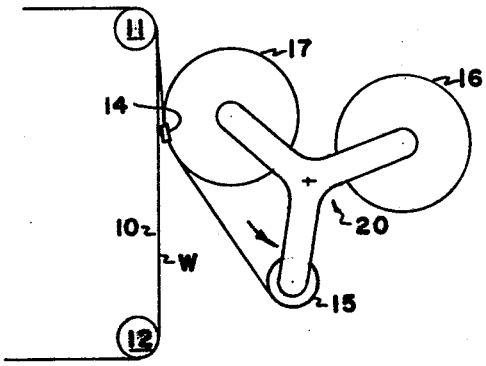

To be noted from FIG. 4C is the angular position of the full reel 17 relative to the corresponding spider arm 47 when the surface profile of the full reel tangentially contacts the remaining tail of web W on depleted reel 15. The index location of adhesive strip 14 should be in the proximity of this point of tangential contact so as to be firmly pressed into the web tail W upon completion of the spider rotation.

Figure 4D:
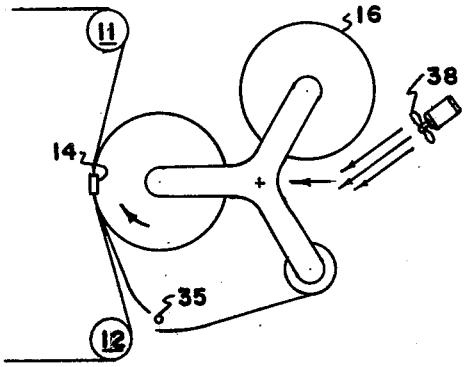

During the interim between engagement of the adhesive strip 14 with the tail of depleted reel 15 and the full pressure engagement of the full reel 17 with the pulling belt 10, a length of web W will be drawn out from the depleted reel across the air stream of fan 38 passing through the space between reels 15 and 16. Pressure from such an air stream will billow the web from a straight line tangent between the reels 15 and 17 beyond the envelope of space required for spider wheel rotation and against the hot wire 35 as illustrated by FIG. 4D. Only brief contact with the wire 35 is required for complete severence of the web W from the tail remaining on core 58.

As the rotation of spider wheel 20 is completed, power for the wire 35 and the fan motor 39 is terminated. Such spider 20 rotational completion is signaled by the closure of limit switch 63 triggered by passage of one spider arm whereupon the converting machine is returned to the running mode and the cylinder 30 is contracted to draw the surface of full reel 17 into the pulling belt 10 with a discretely measured bearing force determined by the standing pressure within cylinder 30.

Having fully described by invention, I claim:

1. A method of transferring web continuity from a depleted supply reel to a replacement supply reel, each rotatively mounted on respective arms of a turret unwind stand whereby the active supply reel engages a surface drive belt at an active supply position, said method comprising the steps of:

A. Rotatively indexing said depleted supply reel away from said active position and said replacement supply reel into said active position whereby the web surface of said replacement reel engages a remaining web tail from said depleted reel against said drive belt;

B. Adhesively securing the web of said replacement reel to said remaining tail; and, C. Directing a flow stream of air against an inside surface of said remaining tail to billow same beyond a sweep radius traversed by said depleted reel upon rotation from said active position, said tail being billowed against a length of resistively heated metallic wire spanning the width of said remaining tail to sever same.

2. A reeled web unwind stand comprising:

A. Rotatively indexed turret means having a plurality of radially projected arms to which respective reels of web material are rotatively secured at distal ends thereof;

B. Reel surface drive belt means for rotating a turret mounted web supply reel indexed to an active supply position;

C. Resistively heated wire means spanning the width of said web and positioned beyond the radial sweep of a depleted reel when rotatively indexed away from said active supply position; and, D. Air supply means directed against an inside surface of a web tail remaining from said depleted reel when indexed from said active supply position to billow said tail beyond said radial sweep and against said wire means.

3. A reeled web unwind stand as described by claim 2 wherein said air supply means is positioned beyond the radial sweep of said turret means and reels mounted thereon, air discharged by said supply means being directed through spaces between said turret mounted reels.

* * * * *